United States Patent [19]

Crofts et al.

[11] 4,255,226

[45] Mar. 10, 1981

[54] DEVICES FOR AIDING THE PREPARATION OF GRAPHIC ARTWORK

[75] Inventors: Michael E. Crofts, Kingston-Upon-Thames; Michael S. Peevers; Eileen S. Peevers, both of Gillingham, all of England

[73] Assignee: Kew Research Limited, Kew, England

[21] Appl. No.: 954,074

[22] Filed: Oct. 24, 1978

[30] Foreign Application Priority Data

Oct. 27, 1977 [GB] United Kingdom ..... 44702/77

[51] Int. Cl.[3] ..... B44C 3/00; B05C 13/02

[52] U.S. Cl. ..... 156/541; 33/1 M; 33/443; 101/127.1; 118/505; 269/56

[58] Field of Search ..... 156/556, 541, 540, 538, 156/542; 33/174 B, 1 M, 443, 477, 445, 449, 174 G, 23 K, 41 B, 41 D, 45, 32 E, 32 D; 101/114, 127, 127.1, 128, 128.1, 128.2, DIG. 12, 407 BP, 403; 269/3, 55, 56, 63, 64; 35/37, 38; 118/504, 505, 76; 248/424, 429, 430

[56] References Cited

U.S. PATENT DOCUMENTS

| | | | |
|---|---|---|---|
| 952,589 | 3/1910 | Tanner | 101/128 |
| 1,985,715 | 12/1934 | Bucky | 33/23 K |
| 2,369,602 | 2/1945 | Petty et al. | 101/127 |
| 3,295,211 | 1/1967 | Nisenson | 33/23 K |
| 3,386,191 | 6/1968 | Michel | 35/88 |

*Primary Examiner*—Michael W. Ball

*Attorney, Agent, or Firm*—Larson, Taylor and Hinds

[57] ABSTRACT

A device for supporting and guiding a master sheet in relation to an item of artwork comprises a carrier in the form of a rectangular frame having means for locating a master sheet on the frame, an intermediate guide which cooperates with the carrier to restrain the carrier to reciprocate in its own plane relatively to the intermediate guide solely in a first direction, which is parallel to two sides of the carrier, and means for supporting the intermediate guide upon a drawing board while restraining the intermediate guide to reciprocate parallel to the plane of the carrier relatively to the drawing board solely in a second direction perpendicular to the first direction.

5 Claims, 22 Drawing Figures

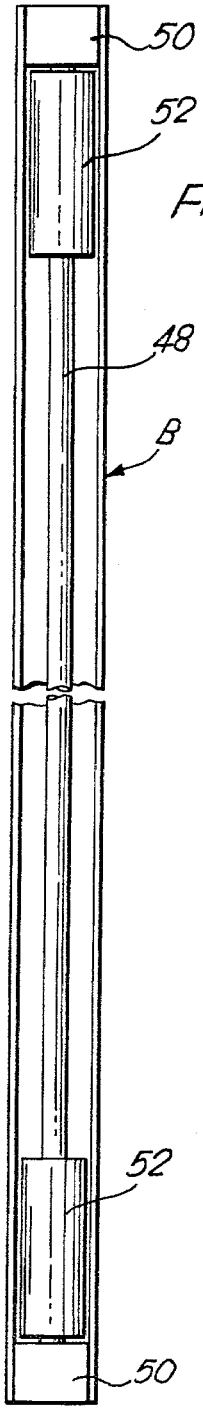
Fig. 14.
Fig. 15.
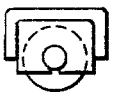
Fig. 9.
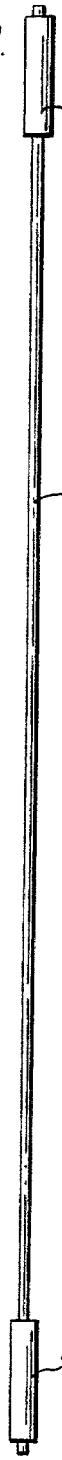

DEVICES FOR AIDING THE PREPARATION OF GRAPHIC ARTWORK

One of the techniques used extensively in the preparation of graphic artwork is the dry transfer process. In this process, sheets are sold which carry on one face letters or other symbols or small pictures (e.g. pictures of trees for use on architects' plans). A user places the sheet face down on the item of artwork, and rubs the back of the sheet with a rounded implement over the area of a selected symbol or picture. The consequence is that the symbol or picture becomes preferentially adherent to the artwork, and the sheet can then be peeled away from the symbol or picture. For convenience in the remainder of this specification we shall refer to "letters", it being understood that the discussion is applicable also to other symbols and pictures.

Current practice is for a draughtsman to locate a dry transfer sheet relatively to artwork solely by hand and eye. To assist himself, he may rule pencil guide lines on the artwork beforehand. However, it is not at all easy to place a succession of letters accurately. They require to be upright, at a uniform level, and suitably spaced. The difficulties become more acute the smaller the size of letter.

The present invention relates to devices for supporting and guiding a master sheet in relation to an item of artwork.

According to this invention such a device comprises a carrier in the form of a rectangular frame having means for locating a master sheet on the frame, an intermediate guide which cooperates with the carrier to restrain the carrier to reciprocate in its own plane relatively to the intermediate guide solely in a first direction, which is parallel to two sides of the carrier, and means for supporting the intermediate guide upon a drawing board while restraining the intermediate guide to reciprocate parallel to the plane of the carrier relatively to the drawing board solely in a second direction perpendicular to the first direction.

The means for supporting the intermediate guide may be in the form of a base which can be secured on the drawing board, or may be in the form of rollers which can run over the surface of the drawing board (or over artwork mounted on the board). The use of a base will be described first.

In a simple form, the intermediate guide is also a rectangular frame and so is the base. The three frames may be superimposed, and the guidance may be provided by ribs on one frame engaging grooves on the next frame.

For convenience, in this specification and claims, the devices will be described using the terminology usually applied to a drawing on a drawing board; that is to say "top" means the side furthest from the user and "bottom" means the side nearest to the user. "Vertical" means to and from the user, and "horizontal" means from left to right and right to left of the user.

Preferably the master sheet is gripped by the "top" and "bottom" members of the carrier.

Preferably the movement of the carrier relative to the intermediate guide is "vertical", while the movement of the intermediate guide relative to the drawing board is "horizontal".

Preferably the "vertical" movement is controlled in a step-by-step manner, e.g. by a detent cooperating with a series of equally spaced depressions, and the letters on the master sheet are in lines which are at the same vertical intervals as the intervals of the vertical movement. In this way, successive letters from different lines on the sheet may be brought easily into alignment in the same line in the artwork, and successive lines of lettering in the artwork may be easily placed at desired intervals. Sheets having letters in lines spaced to suit a particular device are in themselves a novel feature of this invention. An example is letters intended to be used at line intervals greater than the letter size, e.g. "10 point" letters to be at "12 point" line intervals.

Although three rectangular frames have been mentioned above, we prefer that the base, if used, should consist essentially of two parallel elongate members, not fixed together. The members of the base can extend horizontally, and can have a length about twice the horizontal dimension of a master sheet.

If rollers are used, then preferably they are arranged to permit horizontal movement of the intermediate guide relative to the drawing board. The intermediate guide may consist of two parallel elongate members, not fixed together, extending "vertically". Each member has journalled in it an axle extending along the member and carrying two rollers.

Preferably, in all cases, the interengagement of the carrier with the intermediate guide is such that the carrier can, when desired, be lifted from the intermediate guide, without disturbing the positions of the intermediate guide, and the base if used, on the artwork. In particular, the carrier can be exchanged for another to which a different sheet has been attached, for example a sheet with a different size or style of letters.

The invention can be used as an aid with other techniques besides that of dry transfer, and the term "master sheet" is intended to be generic to sheets for such other techniques as well. As one example, the sheet may be a stencil which is used to guide a tubular pen. As another example, the sheet may carry positive or negative masters for use in a photographic process.

The accompanying drawings show five examples of devices according to the present invention. In these drawings:

FIG. 9 is a detail, viewed in the direction of the arrows IX—IX in FIG. 8;

FIG. 14 is a view from below of one half of the intermediate guide;

FIG. 15 is an end view of FIG. 14;

Figure 1:
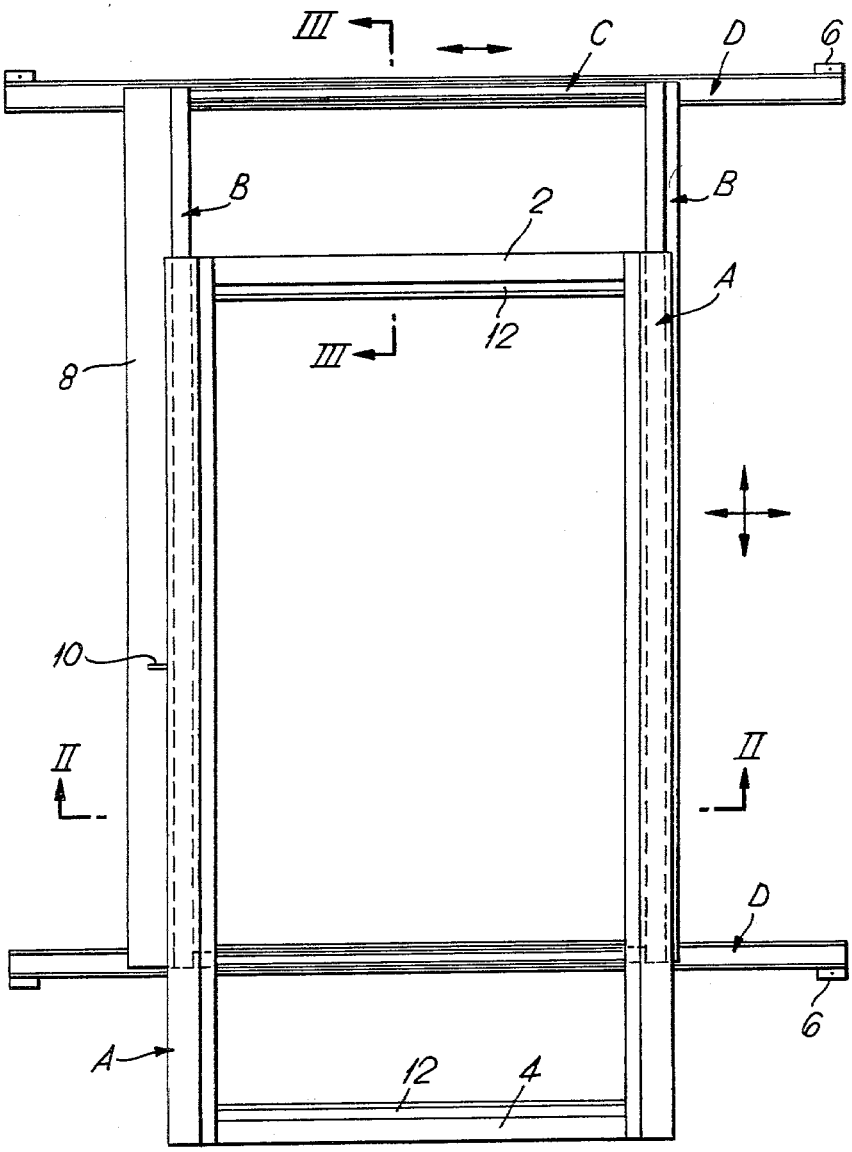
FIG. 1 is a plan view of the first device.
Figure 2:
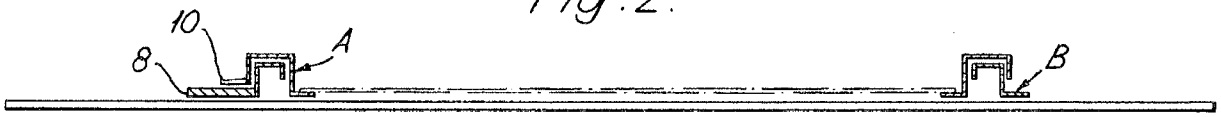
FIG. 2 is a section on the line II—II in FIG. 1.
Figure 3:
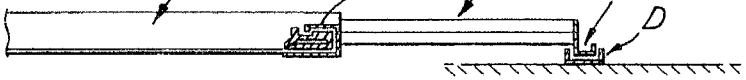
FIG. 3 is a fragmentary section on the line III—III in FIG. 1.

In the device shown in FIGS. 1, 2 and 3, the carrier is in the form of a rectangular frame consisting of runner guides A at left and right, and a head frame and tail frame 2 and 4 at top and bottom. The guides A are of uniform identical cross section, and can be cut from an extruded strip. Likewise the head frame and tail frame 2 and 4 are of another identical uniform cross section, and can be cut from another extruded strip. At the corners of the carrier, the guides A are fixed to the head frame and tail frame 2, 4 by means not shown, for example spot welding if the members are of metal, or solvent welding if the members are of plastics.

The intermediate guide is in form of another rectangular frame comprising two runner guides B extending vertically, and two runner guides C extending horizontally. Again, these members B and C are of uniform cross section, cut from extruded strip, and the members are fixed together by means not shown at the corners of the intermediate guide.

The base consists of two runner guides D extending horizontally. These members D are not fixed together, but their spacing from one another is of course determined by the intermediate guide. These members D can be fixed down onto an item of artwork by tags 6, which can receive pins or adhesive tape.

As is apparent from FIG. 3, the members C and D are channel-shaped in cross section, with their flanges directed away from the artwork. As is apparent from FIG. 2, the members A and B are basically channel-shaped in cross section, with their flanges facing towards the artwork, but one flange on each member has an outward lip. The lip on the members A facilitates connection to the head and tail frames 2 and 4. The lip on the members B provides a means of attaching to one of the members B a scale 8. A pointer 10 attached to the associated member A cooperates with this scale.

As shown, the members D have a length equal to about twice the horizontal internal dimension of the carrier. This means that a master sheet mounted in the carrier (by means described below) can be traversed horizontally through its entire width, and during this traverse the entire length of each member C will remain in interengagement with the corresponding member D.

In the example shown, the members A and B are only slightly longer than the vertical dimension of the internal opening of the carrier. To facilitate movement up and down of a master sheet, it is preferable for the members B to be longer than is shown in FIG. 1. This may be achieved either by increasing the spacing between the members B, or by prolonging the members B beyond one or both members C.

Figure 6:
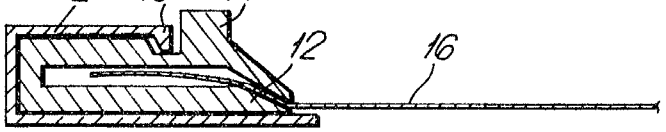
FIG. 6 is an enlarged section corresponding to part of FIG. 3, but looking in the opposite direction.
Figure 7:
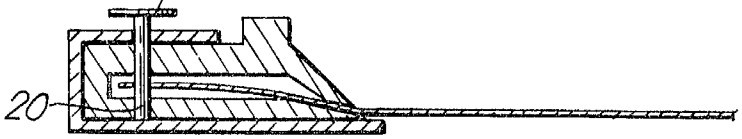
FIG. 7 is a view similar to FIG. 6, showing an alternative arrangement.

Methods of mounting a master sheet of dry transfer material in the carrier are illustrated by FIGS. 6 and 7. We consider first FIG. 6. The head frame 2 in cross section is a channel open towards the interior of the carrier, with a lower flange somewhat longer than the upper flange, and with a slightly down-turned edge on the upper flange. A gripper strip 12 is capable of fitting within the head frame 2. An exactly similar construction exists in relation to the tail frame 4. The gripper strip is of flexible plastics material, and it defines a slit, the bounding surfaces of which are rough.

In order to mount a master sheet, the gripper strips are pulled out of the head frame and tail frame. To enable this to be done, the strip has a rib 14 which can be grasped. Then one edge (for example the bottom) of the sheet 16 is inserted fully into the slit in the gripper strip, and the gripper strip is pushed back into the tail frame. The top edge of the sheet 16 is then pushed into the other gripper strip, and that gripper strip is pushed into the head frame. During this movement, the sheet 16 becomes taut, and there is a small amount of slipping between the sheet and the bounding surfaces of the slits in the gripper strips before the second gripper strip is pushed fully into the head frame. Thereupon, the gripper strips are retained in position by the closely-matching shape of the head and tail frames, including the down-turned lips 18, while the master sheet is held sufficiently firmly by friction in the slits in the gripper strips.

If a more positive grip is desired, then the alternative construction in FIG. 7 may be used, which includes pins 20 carried by blade springs 22 fixed to the upper flange of the head frame and tail frame. During insertion of a gripper strip, these pins are pulled upwards out of the path of the gripper strip. When the gripper strip is fully inserted, the pins are permitted, or assisted, to move downwards thus passing through prepared holes in the gripper strip, and also making closely-fitting holes in the marginal parts of the master sheet, so that the master sheet is located exactly. With this construction, there is no down-turned lip on the upper flange of the head and tail frames.

Figure 4:
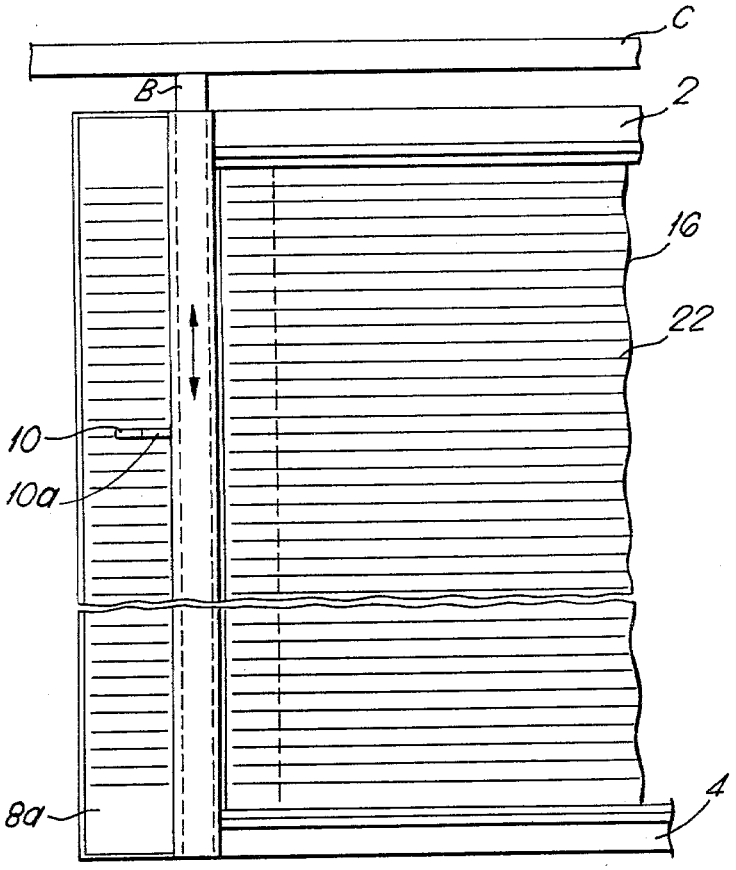
FIG. 4 is a plan of a second device.
Figure 5:
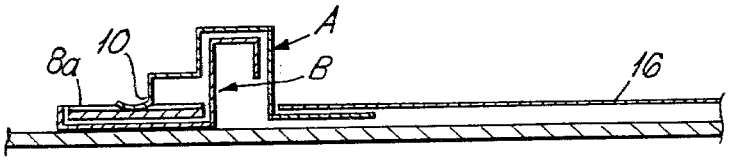
FIG. 5 is a fragmentary section, similar to FIG. 2, but showing the second device.

FIGS. 4 and 5 show the use of a scale 8*a* which has horizontal lines either etched or in relief, which cooperate with the pointer 10*a*, and thus serve to locate the carrier in a series of definite alternative positions in the vertical direction. As explained above, these positions can be uniformly spaced, to match uniform spacing of symbols on the master sheet, as indicated by lines at 22 in FIG. 4. To produce this action, the pointer is constructed so as to be somewhat resilient in a vertical direction, normally engaging the scale, but being able to yield upwards when the carrier is shifted from one definite position to the next.

A similar arrangement of pointer and scale may be provided to control the relative horizontal movement of one pair of members C and D, if the nature of the master sheet or the artwork makes this desirable, for example if the vertical alignment of symbols is important.

In the example shown, the interengagement between the carrier and the intermediate guide is such that the carrier may readily be lifted off the intermediate guide, and replaced by another carrier. If this replacement is not important, then the interengagement may have a more interlocking character; this will prevent the carrier lifting unintentionally from the intermediate guide, for example at the top or the bottom as a result of tilting, and it may then be less necessary for the vertical length of the members B to be greater than the members A. Similar considerations apply to the interengagement of the members C and D.

It is of course essential that the interconnections at the corners of the carrier and of the intermediate guide should be made so that they do not interfere with the desired relative vertical sliding of the carrier and intermediate guide nor with the desired relative horizontal sliding of the intermediate guide and the members D of the base.

The proportions of the example shown are suitable for a device for use with a dry transfer master sheet of A4 standard size. Of course the proportions can be varied to suit the nature of the master sheet. For example, a wet stencil may have an area considerably smaller than an A4 sheet.

A possible alternative to the arrangement shown would be to construct the carrier and the base each as a rectangular frame, while the intermediate guide is in the form of four separate pieces, each consisting of two short runners at right angles to one another, one engaging the base and the other engaging the carrier. This form of construction is more suitable for a device in which the carrier, intermediate guide, and base are more or less permanently assembled by the engagement of interlocking cross sections.

Although, on grounds of economy of material, we prefer to construct the devices from extruded strips, it is possible for one or more of the carrier, intermediate guide, and base to be a rectangular frame of integral construction, either moulded, or cut from a sheet of adequate rigidity. With such a construction, the interengagement between the components can be by way of ribs on one component engaging grooves on the other.

Preferably, as in the example shown, the method by which the base is located relatively to the artwork is applicable anywhere over a flat drawing surface. This is in contrast to various kinds of draughtman's equipment which require to be attached to the edge or frame of a drawing board.

Figure 8:
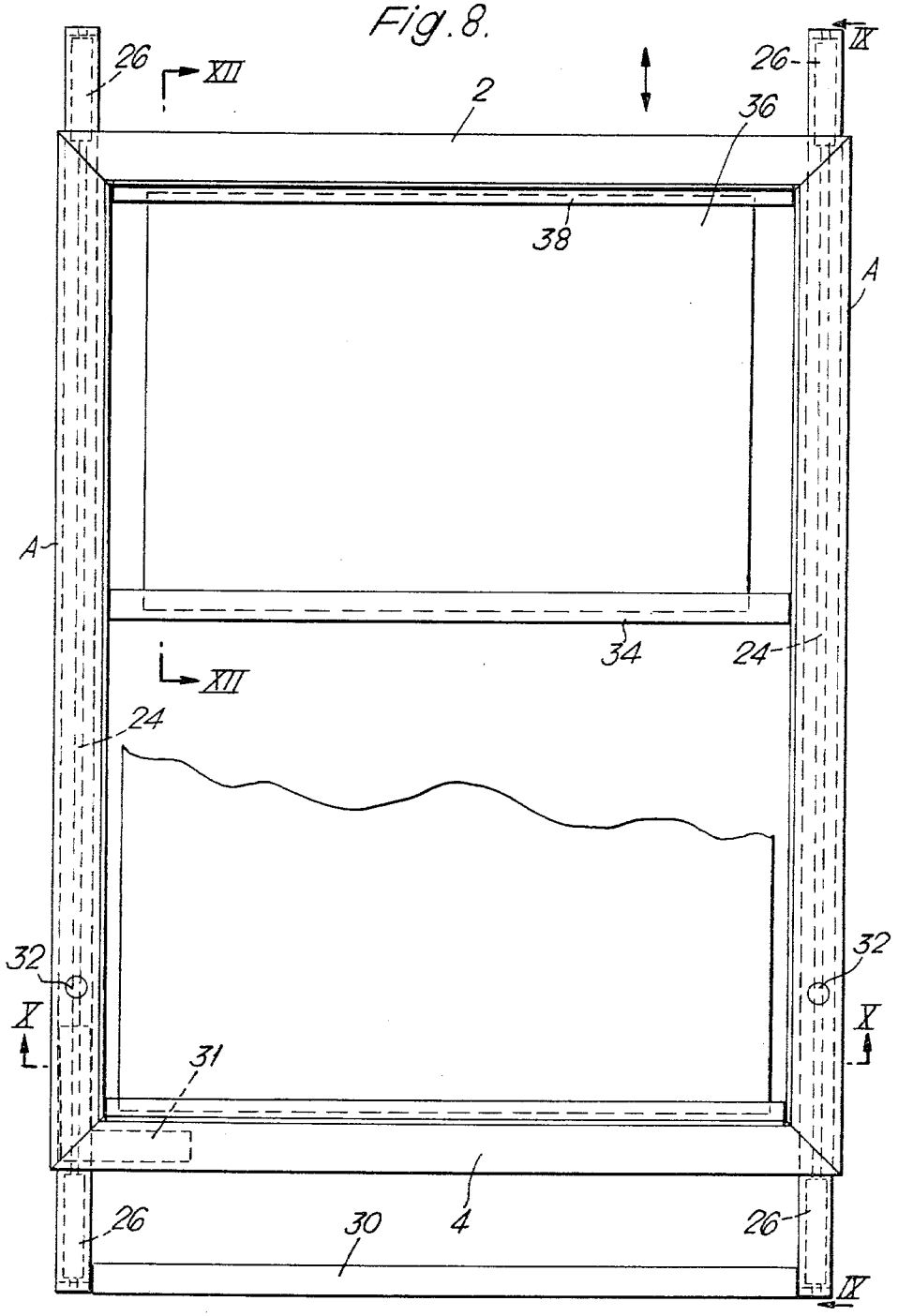
FIG. 8 is a plan view of a third device.
Figure 10:
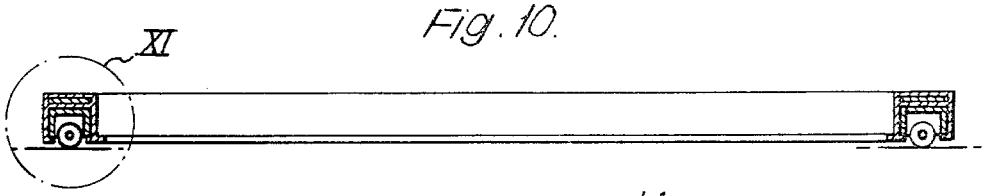
FIG. 10 is a section on the line X—X in FIG. 8.
Figure 11:
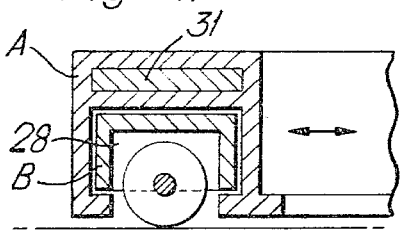
FIG. 11 is an enlarged detail of the area XI in FIG. 10.

In the device shown in FIGS. 8 to 10, the carrier closely resembles that in FIGS. 1 to 3. However, the cross section of the members A is an inverted channel, with inturned lips, as shown in FIG. 11.

The intermediate guide is in the form of two separate members, each including a guide B which cooperates with the respective member A. Extending along each member B, and lying partly within its interior, is an axle 24, having on each end a roller 26 constituted by a rubber sleeve forced onto the axle. The axle 24 is journalled in the member B by blocks 28 (FIG. 11).

In use, the device shown in FIG. 8 is laid upon a drawing board on which a piece of artwork has already been mounted. The frame can then be moved vertically by sliding relatively to the intermediate guide constituted by the members B, and can be moved horizontally, taking the intermediate guide with it, as a consequence of rolling motion of the rollers 26 over the surface of the drawing board and artwork. The presence of four such rollers 26 ensures that there is no significant skidding, provided that the drawing board is not tilted far from a horizontal plane, and consequently the movement of the carrier horizontally is substantially rectilinear.

If the drawing board is to be steeply tilted, then a bar 30 (FIG. 8) can be fitted across the lower ends of the axles 24. This bar can be supported by a drafting machine, parallel motion blade, or T-square.

Preferably, as shown, there is means for locking each guide B relatively to the respective member A of the carrier. Such locking is used when carrying the device about, and when a user is applying a succession of letters on the same horizontal line. In FIG. 8 a button 32 is shown on each member A. This button is spring-loaded, and controls a soft rubber pad (not shown). When the button is released, the pad engages the underlying guide B, and prevents relative longitudinal movement of the guide B and member A. When the button is depressed, the pad disengages from the guide B, so that the relative movement can occur. The button can be latched in the depressed condition when desired.

Reference has been made above to interconnecting members by welding. However it is also possible to use other methods of fixing, including those which can be carried out by a private individual. FIGS. 8 and 11 are an example. The members A and frames 2 and 4 are cut with mitred ends from extruded sections, and are held together by L-shaped corner plates 31 secured in push-fit slots by fasteners or adhesive. Thus it may be possible to market the device as a kit of parts, to be assembled by the purchaser. If all the members are of extruded strip, then the parts can be contained in a very compact package, which facilitates marketing.

An incidental advantage of the use of the present invention in connection with dry transfer sheets is that the user does not have to manipulate the sheets by hand repeatedly, and therefore there is no danger of symbols, expecially those near the vertical edges of the sheet, being damaged by handling and thus wasted.

Figure 12:
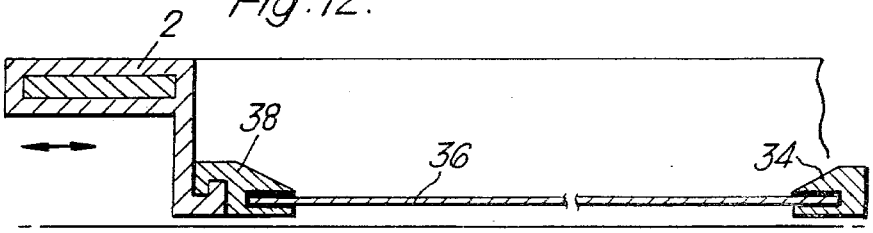
FIG. 12 is an enlarged cross section on the line XII—XII in FIG. 8.

FIGS. 8 and 12 illustrate the use of a carrier to support a stencil, which is of smaller area than a dry transfer sheet. For this purpose, an intermediate rail 34 is laid across the carrier, with ends of the rail resting on a flange of each member A. The stencil 36 is received by the rail 34 and by a gripper strip 38 carried by the head frame 2.

FIGS. 13 to 18 show another form of device, in which again the intermediate guide is in the form of two separate members, each incorporating an axle carrying two rollers.

Figure 16:
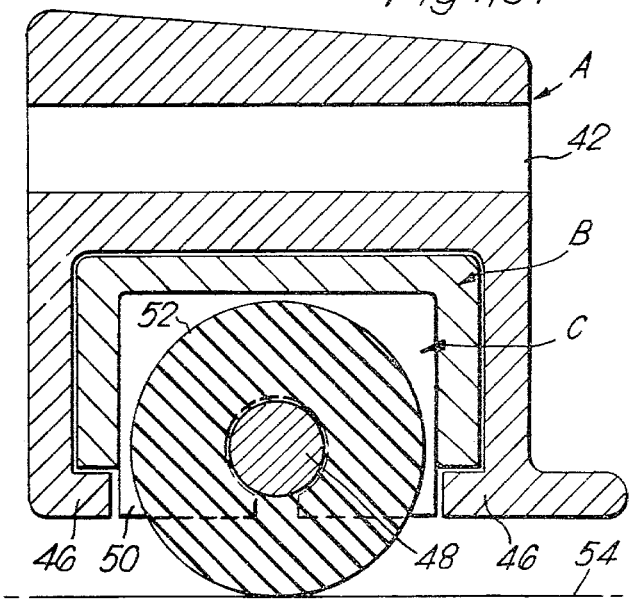
FIG. 16 is a greatly enlarged section on line XVI—XVI in FIG. 13.
Figure 13:
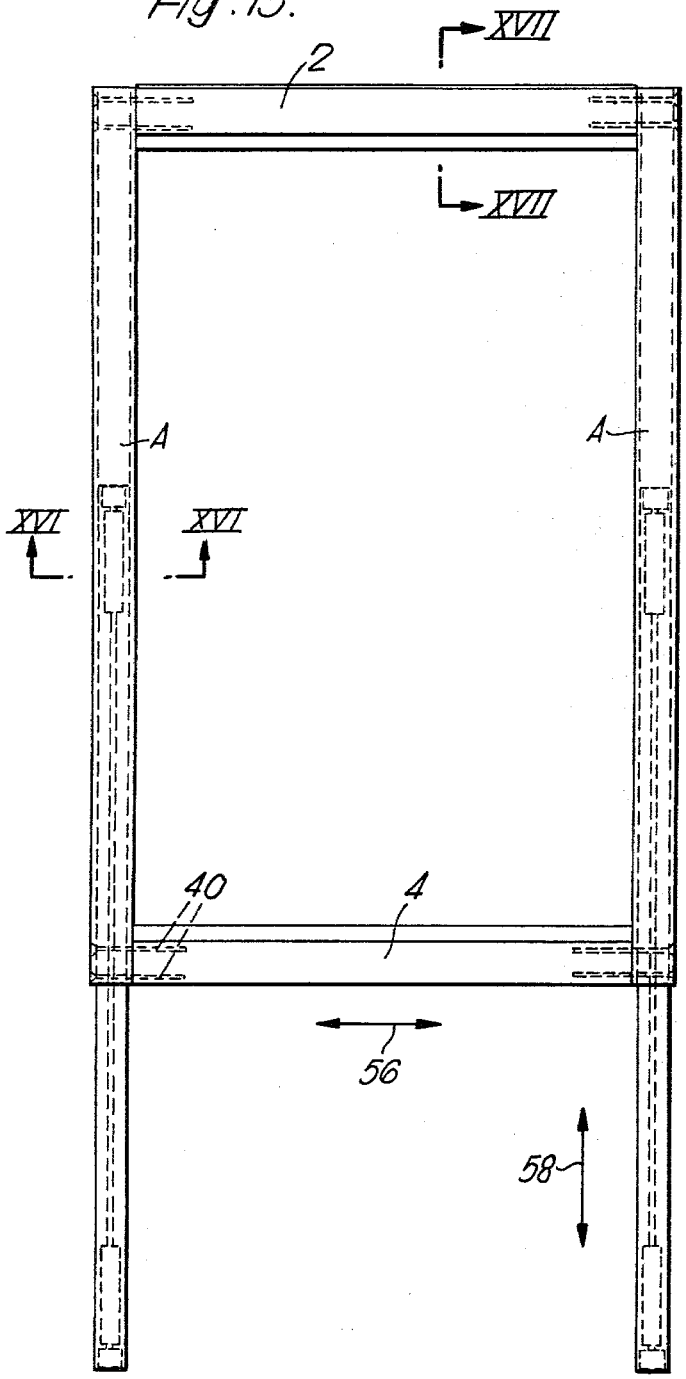
FIG. 13 is a plan view of a fourth device.
Figure 17:
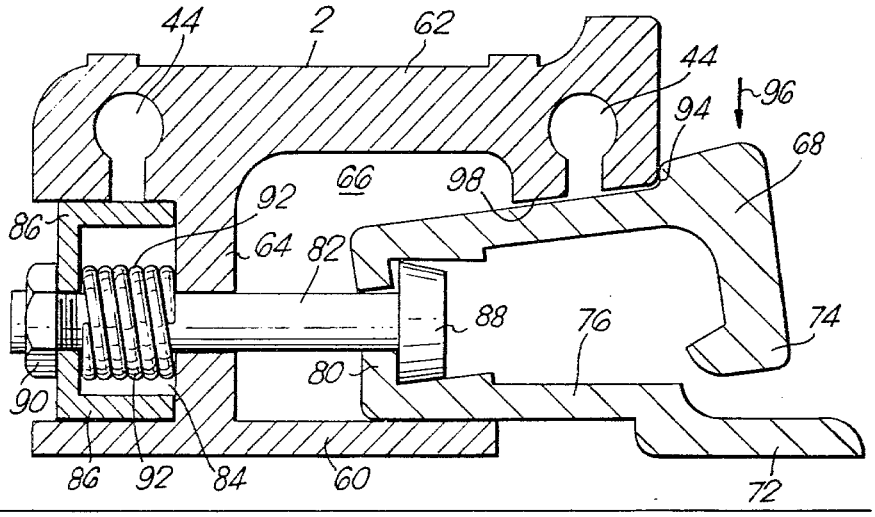
FIG. 17 is a greatly enlarged section on line XVII—XVII in FIG. 13.

As shown in FIG. 13, the carrier is in the form of a rectangular frame consisting of runner guides A at left and right, and a head frame and tail frame 2 and 4 at top and bottom. The cross section of the runner guides A is shown in FIG. 16. The cross section of the head frame and tail frame 2 and 4 is shown in FIG. 17. The guides A are secured to the frames 2 and 4 by bolts, in positions indicated at 40 in FIG. 13 at each corner. These bolts pass through prepared holes 42 (FIG. 16) into the ends of key-hole section grooves 44 shown in FIG. 17. The bolts are self-tapping in the grooves 44.

Each intermediate member, as shown in FIGS. 14, 15 and 16, includes a guide B which cooperates with the respective guide A. In cross section, as shown in FIG. 16, the guide B is an inverted channel, while the guide A has a corresponding recess, with inwardly-directed flanges 46.

Within the interior of the guide B is an axle 48, which is journalled at each end in a block 50. The axle 48 carries two rollers 52, which in this case are within the length of the guide B. These rollers, as shown in FIG. 16, project below the bottom faces of the guide A, and can roll upon the surface 54 of a drawing board, or of artwork fixed on the drawing board.

The rollers provide for movement of the carrier in the direction of the arrows 56 in FIG. 13, while the guides A, B provide for movement of the carrier in the direction of the arrows 58.

Figure 18:
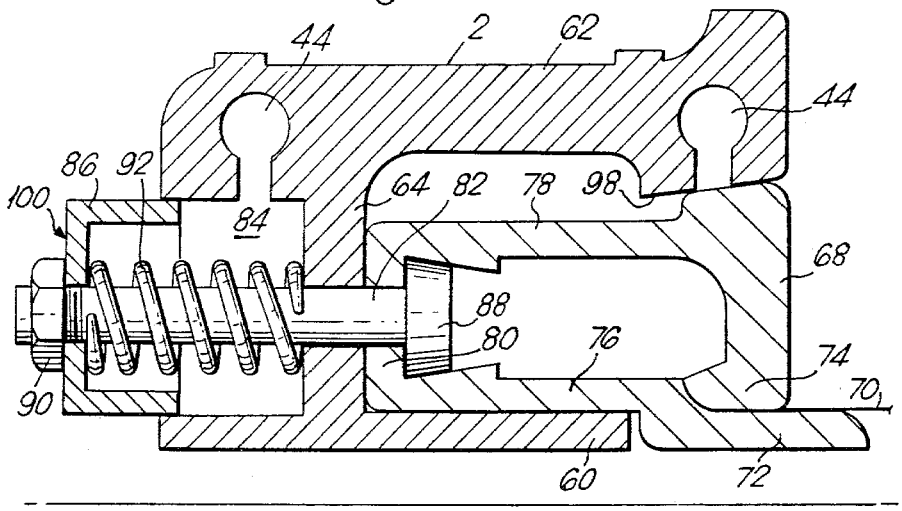
FIG. 18 is a view similar to FIG. 17 showing an alternative condition.

FIGS. 17 and 18 illustrate the means by which a master sheet is secured to the head frame and tail frame 2 and 4. In cross section, as shown in FIG. 17, the head frame 2 is essentially of channel section, with flanges 60 and 62 directed towards the centre of the carrier, and inconnected by a web 64. The flanges define a cavity 66 which accommodates a clamping strip 68. In FIG. 17 the clamping strip is shown in open condition, in which it is unstressed, or only slightly stressed, while FIG. 18 shows the clamping strip 68 in closed condition. In the closed condition a margin of a master sheet 70 is gripped between two jaws 72, 74. Considering the clamping strip 68 in cross section, as seen in FIGS. 17 and 18, these jaws are carried by two flanges 76 and 78, linked by a web 80. The entire clamping strip 68 is extruded of a resilient plastics material.

At intervals along its length, there are holes through the web 80, which receive pins 82. These pins pass through correspondingly spaced holes in the web 64 of the head frame 2. To the left of the web 64, as seen in FIGS. 17 and 18, there is a further recess 84 in the head frame 2, and this recess accommodates a bar 86 of channel section. The pins 82 pass through holes in the bar 86, and each pin has a head 88 and carries a locknut 90. A helical compression spring 92 surrounds each pin 82, and is confined between the bar 86 and the web 64.

If the bar 86 is pushed by hand into the recess 84, as shown in FIG. 17, then the clamping strip 68 assumes the position shown in FIG. 17, in which the jaws 72 and 74 are separated. A step 94 on the clamping strip then engages an end face of the flange 62, and retains the clamping strip in the open condition. Pressure as indicated by the arrow 96 will disengage the step 94, whereupon the springs 92 will expand, and draw the clamping strip 68 into the condition shown in FIG. 18. It will be seen that an inclined surface 98 on the flange 62 has the effect of urging the jaw 74 downwards, while the jaw 72 is supported by the flange 60.

In use, the top and bottom margins of the master sheet 70 are each clamped by first placing the margin between the jaws 72 and 74 in the condition shown in FIG. 17, and then applying pressure at 96, so as to cause the respective clamping strip 68 to assume the condition shown in FIG. 18, with the consequence that the master sheet is pulled taut, and clamped securely. The master sheet can be released by application of pressure to each bar 86, as indicated by the arrow 100 in FIG. 18.

The fifth carrier shown in FIGS. 19 to 22 has a rectangular frame made up of two guides A, a head frame 2, and a tail frame (not shown). Adjacent to and parallel to the head frame 2 is a gripping bar 101, described in detail below. There is an exactly similar gripping bar adjacent to the tail frame (not shown).

Figure 19:
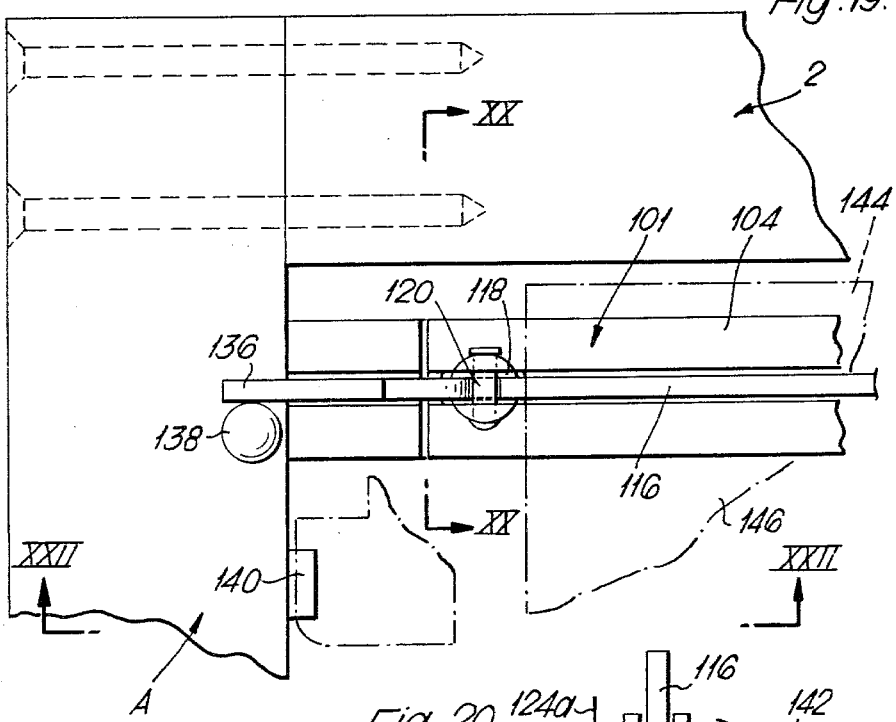
FIG. 19 is a fragmentary plan of the carrier of a fifth device.
Figure 20:
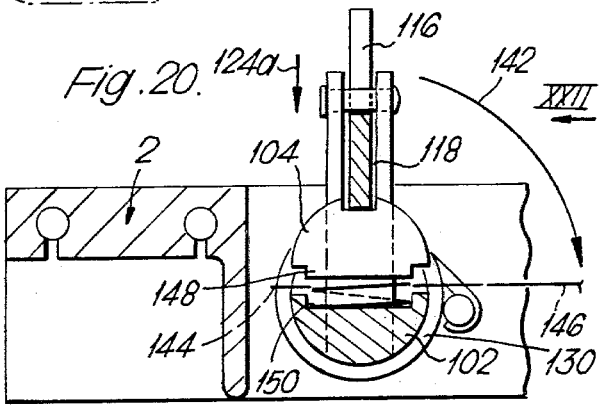
FIG. 20 is a section on the line XX—XX in FIG. 19.
Figure 21:
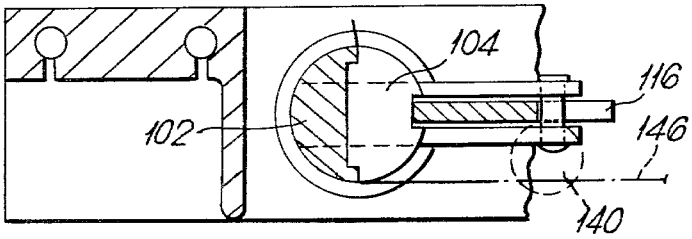
FIG. 21 is a section similar to FIG. 20, but showing the "gripping" condition of the components.
Figure 22:
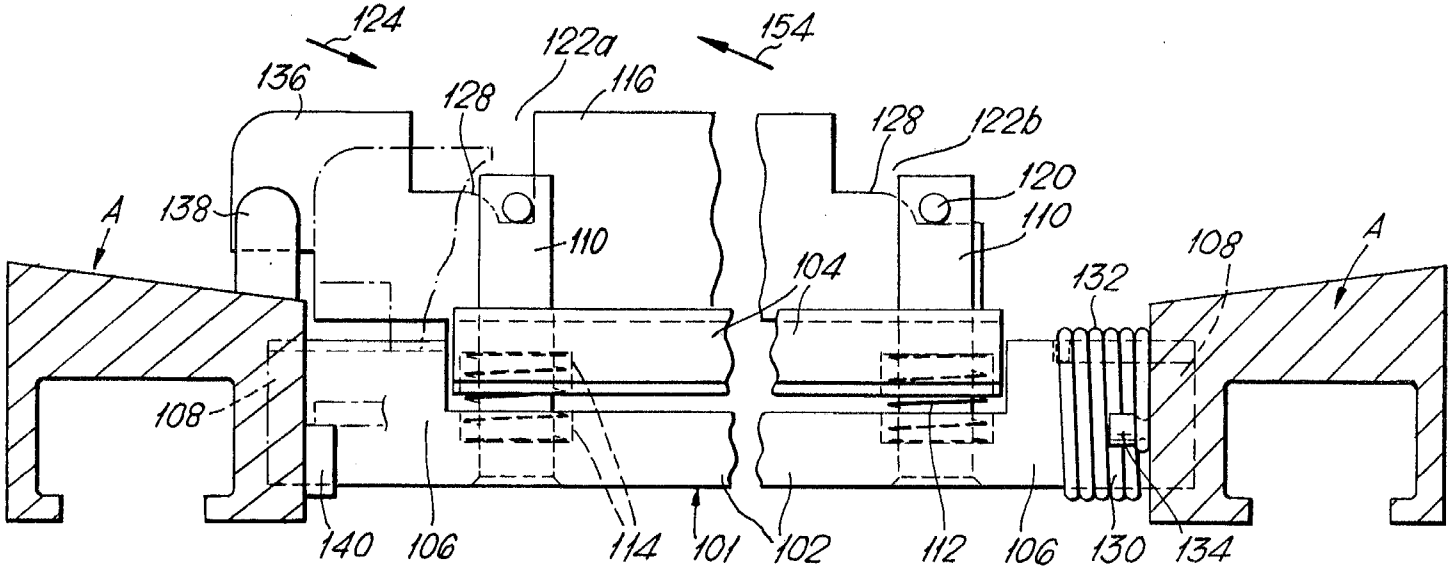
FIG. 22 is a section on the line XXII—XXII in FIG. 19, corresponding to a view in the direction of the arrow XXII in FIG. 20.

Each gripping bar 101 consists of a substantially semi-cylindrical jaw 102, and a substantially semi-cylindrical movable jaw 104. FIGS. 19, 20 and 22 show these jaws in an "open" condition. At each end of the jaw 102 there is a cylindrical portion 106, which is journalled in a cylindrical recess 108 in the respective guide A. The gripping bar can rotate bodily through an angle of 90° between the position shown in FIG. 20, and the position shown in FIG. 21. In addition, the movable jaw 104 can be moved relatively to the jaw 102 into a "gripped" condition, shown in FIG. 21.

The movable jaw 104 is guided on two posts 110, fixed to the jaw 102. The jaws are urged apart by coil springs 112 in pockets 114 in the jaws. Movement of the movable jaw 104 is controlled by a cam bar 116, which lies in slots in the posts 110. Each slot 118 is crossed by a pin 120, and the cam bar 116 has two notches **122*a* and 122*b* which cooperate with the respective pins 120**.

In the position shown in solid lines in FIGS. 19, 20 and 22, the bottoms of the notches **112*a* and 122*b* are in engagement with the pins 120. If a force is applied to the cam bar 126 in the direction of the oblique arrow 124 in FIG. 22, the curved surfaces 128 cooperate with the pins 120 in guiding the cam bar so that, considered in FIG. 22, the cam bar simultaneously moves downward, and in so doing urges the movable jaw 104** downward, and moves to the right in relation to all the remainder of the gripper bar.

Considering FIG. 20, the gripper bar is urged in a clockwise direction by a coil spring 130, one end of which is anchored in a groove 132 in the bar, while the other end is anchored by a screw 134 to one of the guides A. This spring is wound several turns around the right-hand portion 106 in FIG. 22.

In the position shown in FIGS. 19, 20 and 22, clockwise rotation of the gripping bar is prevented by engagement of the end 136 of the cam bar with a peg 138 (FIGS. 19 and 22) fixed to the left-hand guide A.

When the cam bar 116 has been displaced in the direction of the arrow 124, the end 136 disengages from the peg 138. Thereupon, the spring 130 rotates the gripping bar until the end 136 abuts against a second peg 140 (FIGS. 19 and 22), fixed to the left-hand guide A.

In FIG. 20, the movement of the cam bar 116 relative to the remainder of the gripping bar is indicated by the arrow **124*a* (corresponding to the downward component of the arrow 124 in FIG. 22), while the clockwise rotation is indicated by the arrow 142. FIG. 21** shows the position attained at the conclusion of these movements.

In use, one starts with the components in the "open" condition as shown in FIGS. 19, 20 and 22. One edge 144 of a master sheet 146 is inserted between the jaws 102 and 104 (from the right as seen in FIG. 20). The width of the sheet is slightly less than the distance between the posts 110.

The movement of the jaw 104, followed by the rotation of the gripping bar, bringing the components to the position shown in FIG. 21, causes the master sheet 146 to be gripped and tensioned. The grip is enhanced by the provision of a rectangular-sectioned rib 148 on the jaw 104, which cooperates with a correspondingly-sectioned groove 150 in the jaw 102.

In order to release the master sheet, the cam bar 116 is swung in the direction of the arrow 152 in FIG. 21, against the action of the spring 130, through 90°. Then the cam bar 116 is urged in the direction of the arrow 154 into the position of the components shown in FIG. 22, in which the end 136 of the cam bar again cooperates with the peg 138 to retain the components in the "open" condition.

Rotation of the gripping bar through more than 90° from the position shown in FIG. 21 can be prevented by suitable design of the spring 130, so that the coils of the spring become tight around the portion 106 when the position shown in FIG. 20 is reached.

Preferably the cam bar 116 carries at its centre a thumb piece (not shown) by which it can be more easily manoeuvred.

In a simpler variant, now shown, the cam bar 116 is omitted, and the posts 110 are replaced by cylindrical posts which have no slots 118, but which are externally threaded. Wing nuts on these posts are used to press the movable jaw 104 towards the jaw 102. The portion 106 opposite the spring 130 carries a radial pin which in "gripping" condition engages the peg 140. In "open" condition, the radial pin is retained in a position rotated 90° away from the peg 140 by a hook pivoted to the adjacent guide A. This hook is in place of the peg 138.

We claim:

1. A device for supporting and guiding a master sheet in relation to an item of artwork carried by a drawing board, the device comprising: a carrier in the form of a rectangular frame, the frame including two parallel elongated first guides, and including mounting means for detachably mounting a master sheet on the frame; intermediate guide means comprising two parallel elongated second guides, each of said second guides being in interengagement with a respective one of said first guides in a manner confining relative motion between said first guides and said second guides to relative longitudinal reciprocation parallel to a first direction; and elongated roller means, journalled in each of said second guides, for engaging the drawing board to thereby support the device with a master sheet thereon and for restraining said intermediate guide means to reciprocate parallel to the plane of the carrier relatively to the drawing board solely in a second direction perpendicular to the first direction, said first and second parallel elongated guide means comprise interengaging U-shaped channel slides.

2. A device according to claim 1, in which said means for locating a master sheet comprises two means for locating respective opposite edges of a master sheet, each of said two means comprising a gripper strip of flexible plastics material in which is a slit, and two flanges secured to said carrier between which the gripper strip can be pushed.

3. A device according to claim 1, in which said means for locating a master sheet comprises two means for locating respective opposite edges of a master sheet, each of said two means comprising a gripper strip of resilient plastics material including two opposed jaws, means on said carrier defining a cavity, and means for drawing the gripper strip into the cavity, to thereby clamp the jaws together.

4. A device according to claim 1, in which said means for locating a master sheet comprises two means for locating respective opposite edges of a master sheet, each of said two means comprising a gripping bar comprising two substantially semi-cylindrical jaws, one jaw being journalled at its ends in the carrier, while the second jaw is movable to and from the first jaw.

5. A device according to claim 4, including springs urging the jaws apart, a cam bar for urging the jaws together as a consequence of movement along the length of the jaws, and two stops for cooperating with one end of the cam bar.

* * * * *